US010214837B2

(12) United States Patent
Hoover

(10) Patent No.: US 10,214,837 B2
(45) Date of Patent: Feb. 26, 2019

(54) TEXTILE STUFFER BOX AND METHOD FOR TEXTURING YARN

(71) Applicant: American Linc, LLC, Gastonia, NC (US)

(72) Inventor: Donald Lynn Hoover, Clover, SC (US)

(73) Assignee: American Linc, LLC, Gastonia, NC (US)

( * ) Notice: Subject to any disclaimer, the term of this patent is extended or adjusted under 35 U.S.C. 154(b) by 356 days.

(21) Appl. No.: 15/109,290

(22) PCT Filed: Jan. 2, 2015

(86) PCT No.: PCT/US2015/010030

§ 371 (c)(1),
(2) Date: Jun. 30, 2016

(87) PCT Pub. No.: WO2015/103467

PCT Pub. Date: Jul. 9, 2015

(65) Prior Publication Data

US 2016/0319469 A1 Nov. 3, 2016

Related U.S. Application Data

(60) Provisional application No. 61/923,042, filed on Jan. 2, 2014.

(51) Int. Cl.
*D02G 1/12* (2006.01)
*D04H 1/12* (2006.01)

(52) U.S. Cl.
CPC ..... *D02G 1/12* (2013.01); *D02G 1/125* (2013.01); *D04H 1/12* (2013.01)

(58) Field of Classification Search
CPC .... D02J 1/04; D02J 1/06; D02J 13/005; D02J 13/003; D02J 13/00; D02G 1/006; D02G 1/008; D02G 1/12; D02G 1/125; D02G 1/127; D02G 1/122; D02G 1/20
USPC ..... 28/263, 264, 262, 266
See application file for complete search history.

(56) References Cited

U.S. PATENT DOCUMENTS 2,156,723 A * 5/1939 Esselmann ..... D02G 1/12 28/269
3,037,260 A * 6/1962 Pike, Jr. ..... D02G 1/125 19/23
3,373,469 A * 3/1968 Boggs ..... D02G 1/12 28/269

(Continued)

FOREIGN PATENT DOCUMENTS

WO WO/2012/096799 7/2012

*Primary Examiner* — Amy Vanatta
(74) *Attorney, Agent, or Firm* — Schwartz Law Firm P.C.

(57) ABSTRACT

A textile stuffer box comprises a housing assembly having a yarn entrance and a yarn exit, and cooperating interior chamber-forming surfaces. The chamber-forming surfaces defines a multi-stage internal crimping chamber for receiving and accumulating a moving length of ply-twisted yarn between the entrance and exit of the housing assembly. The crimping chamber comprising an upstream fixed-volume stage and a downstream adjustable-volume stage. A weight-balanced gate selectively adjusts a volume of the downstream adjustable-volume stage of the crimping chamber, thereby controlling axial compression of yarn accumulating inside the upstream fixed-volume stage of the crimping chamber.

17 Claims, 8 Drawing Sheets

(56) References Cited

U.S. PATENT DOCUMENTS

| | | | | | |
|---|---|---|---|---|---|
| 3,406,436 | A * | 10/1968 | Clarke, Jr. | D02G 1/125 | 28/250 |
| 3,482,294 | A * | 12/1969 | Jean | D02G 1/12 | 28/255 |
| 3,514,368 | A | 5/1970 | Netsel | | |
| 3,680,181 | A * | 8/1972 | Heijnis | D02G 1/12 | 28/269 |
| 3,737,112 | A | 6/1973 | Tellerman et al. | | |
| 3,813,740 | A * | 6/1974 | Heijnis | D02G 1/12 | 28/221 |
| 3,839,764 | A | 10/1974 | Clayton | | |
| 5,025,538 | A * | 6/1991 | Saleh | D02G 1/12 | 28/263 |
| 6,481,072 | B1 * | 11/2002 | Hoover | D02G 1/12 | 28/263 |
| 6,572,966 | B1 * | 6/2003 | Raskin | D02G 1/12 | 428/357 |
| 7,278,191 | B1 * | 10/2007 | Lane | D02G 1/12 | 28/263 |
| 2006/0191117 | A1 * | 8/2006 | Hoover | D02G 1/12 | 28/221 |
| 2007/0175627 | A1 | 8/2007 | Pippert | | |
| 2008/0301922 | A1 | 12/2008 | Hoover | | |

* cited by examiner

TEXTILE STUFFER BOX AND METHOD FOR TEXTURING YARN

TECHNICAL FIELD AND BACKGROUND OF THE INVENTION

In its exemplary embodiments described herein, the invention relates broadly and generally to a textile processing assembly, stuffer box (also known as a texturing/crimping/frieze box, or chamber), and method for texturing yarn. Yarn textured according to embodiments of the present disclosure may have application in various types of cut-pile carpets—namely, saxony, plush, textured and frieze. Such carpets are manufactured to achieve certain desirable and distinctive surface textures impacting hand, appearance, and wear. As such, a present need exists in the industry for a textile processing assembly, stuffer box, and method applicable to effectively manipulate yarn texture.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the invention or to imply that certain features are critical, essential, or even important to the structure or function of the invention. Rather, these terms are merely intended to highlight alternative or additional features that may or may not be utilized in a particular embodiment of the present invention.

According to one exemplary embodiment, the present disclosure comprises a textile processing assembly for texturing and heatsetting a moving length of ply-twisted yarn. The textile processing assembly includes a pair of feed rolls, a textile stuffer box, a climate chamber, means for conveying the moving yarn downstream from the stuffer box to the climate chamber, and a take-up winder. The feed rolls are adapted for engaging and moving the yarn downstream away from a supply creel.

The textile stuffer box is downstream of the feed rolls, and comprises a housing assembly, an elongated chamber gate, and a removable and selectively positioned gate weight. The housing assembly has a yarn entrance and a yarn exit, and cooperating interior chamber-forming surfaces defining a multi-stage internal crimping chamber for receiving and accumulating the ply-twisted yarn. The crimping chamber comprises an upstream fixed-volume stage and a downstream adjustable-volume stage. Means are provided for selectively adjusting a volume of the downstream adjustable-volume stage of the crimping chamber, thereby controlling axial compression of yarn accumulating inside the upstream fixed-volume stage of the crimping chamber.

The climate chamber is downstream of the stuffer box, and is adapted for heat-setting the ply-twisted yarn. The take-up winder functions to collect the processed yarn downstream of the climate chamber.

According to one exemplary embodiment, the means for selectively adjusting a volume of the downstream adjustable-volume stage of the crimping chamber comprises a pivoted weight-balanced chamber gate and removable gate weight. The chamber gate is pivotably mounted to the housing assembly at an internal fulcrum assembly, and comprises a solid flat inside-the-chamber first end and an outside-the-chamber second end. The inside-the-chamber end defines at least one of the chamber-forming surfaces adjacent the yarn exit of the housing assembly. The removable gate weight is carried on the outside-the-chamber second end of the chamber gate, and is external to the housing assembly for ready access by a user. The gate weight is selectively positioned along the outside-the-chamber second end of the gate to adjustably increase and decrease a resistance exerted by the chamber gate, whereby selective adjustment of the gate resistance operates to control axial compression of yarn accumulating inside of the crimping chamber.

In alternative exemplary embodiments, the means for selectively adjusting a volume of the downstream adjustable-volume stage of the crimping chamber may comprise other devices and assemblies including (for example) electronic or electromagnetic devices, spring-resistance assemblies, sliding gates or walls, and other electronic, mechanical, and electro-mechanical assemblies.

According to another exemplary embodiment, the outside-the-chamber second end of the chamber gate comprises a plurality of longitudinally spaced mounting points for selectively locating the removable gate weight.

According to another exemplary embodiment, the mounting points comprise respective uniformly spaced gate holes formed with the chamber gate. In this embodiment, a threaded mounting pin is adapted for inserting through a selected one of the gate holes into a complementary threaded opening formed with the weight to temporarily secure the weight to the chamber gate.

According to another exemplary embodiment, the housing assembly comprises opposing spaced apart side plates. At least one of the side plates has a substantially transparent section (or "window") to enable outside viewing of ply-twisted yarn accumulating inside the crimping chamber.

According to another exemplary embodiment, a gate-mounting pin extends between the side plates of the housing assembly, and pivotably carries the chamber gate at a fulcrum point between its inside-the-chamber first end and its outside-the-chamber second end.

According to another exemplary embodiment, the textile stuffer box comprises a plurality of rigid chamber spacers extending between the side plates of the housing assembly.

According to another exemplary embodiment, the textile stuffer box comprises a gravity-feed yarn slide extending downwardly at an angle between the entrance and exit of the housing assembly.

According to another exemplary embodiment, the gravity-feed yarn slide extends at a downward angle of between about 45 and 75 degrees from the entrance to the exit of the housing assembly.

According to another exemplary embodiment, the gravity-feed yarn slide is laterally-scored at (longitudinally) spaced apart locations between a top of the slide and a bottom of the slide.

According to another exemplary embodiment, the textile stuffer box comprises top and bottom yarn-guiding blades located at the entrance of the housing assembly adjacent the feed rolls.

In another exemplary embodiment, the present disclosure comprises a textile stuffer box for texturing yarn.

In yet another exemplary embodiment, the present disclosure comprises a method for texturing yarn. The method includes feeding a moving length of yarn into an entrance of a textile stuffer box. The textile stuffer box defines an internal crimping chamber, and comprises an elongated pivoted chamber gate having an inside-the-chamber first end extending towards an exit of the textile stuffer box, and an outside-the-chamber second end comprising a removable gate weight. The gate weight is selectively positioning along the outside-the-chamber second end of the chamber gate to adjustably increase and decrease a yarn resistance exerted by the chamber gate, whereby selective adjustment of the gate resistance operates to control axial compression of yarn accumulating inside of the crimping chamber.

As used herein, the term "yarn" refers broadly to a continuous filament or strand of fibers, such as that used in tufting, weaving, and bonding to form carpet and other fabrics. The yarn may be plied or without twist, and may be either spun staple or continuous filament.

The term "continuous filament" refers to an unbroken strand of synthetic fiber, such as filament nylon or olefin.

The term "crimp" refers to a nonlinear fiber configuration, such as a sawtooth, zigzag or random curl relative to the fiber axis. Fiber crimp generally increases bulk and cover and facilitates interlocking of staple fibers in spun yarns.

The term "textured yarn" refers to a continuous filament manufactured yarn that has been crimped—i.e., modified to create a different surface texture.

BRIEF DESCRIPTION OF THE DRAWINGS

Exemplary embodiments of the present invention will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Textile Processing Assembly 10

Figure 1:
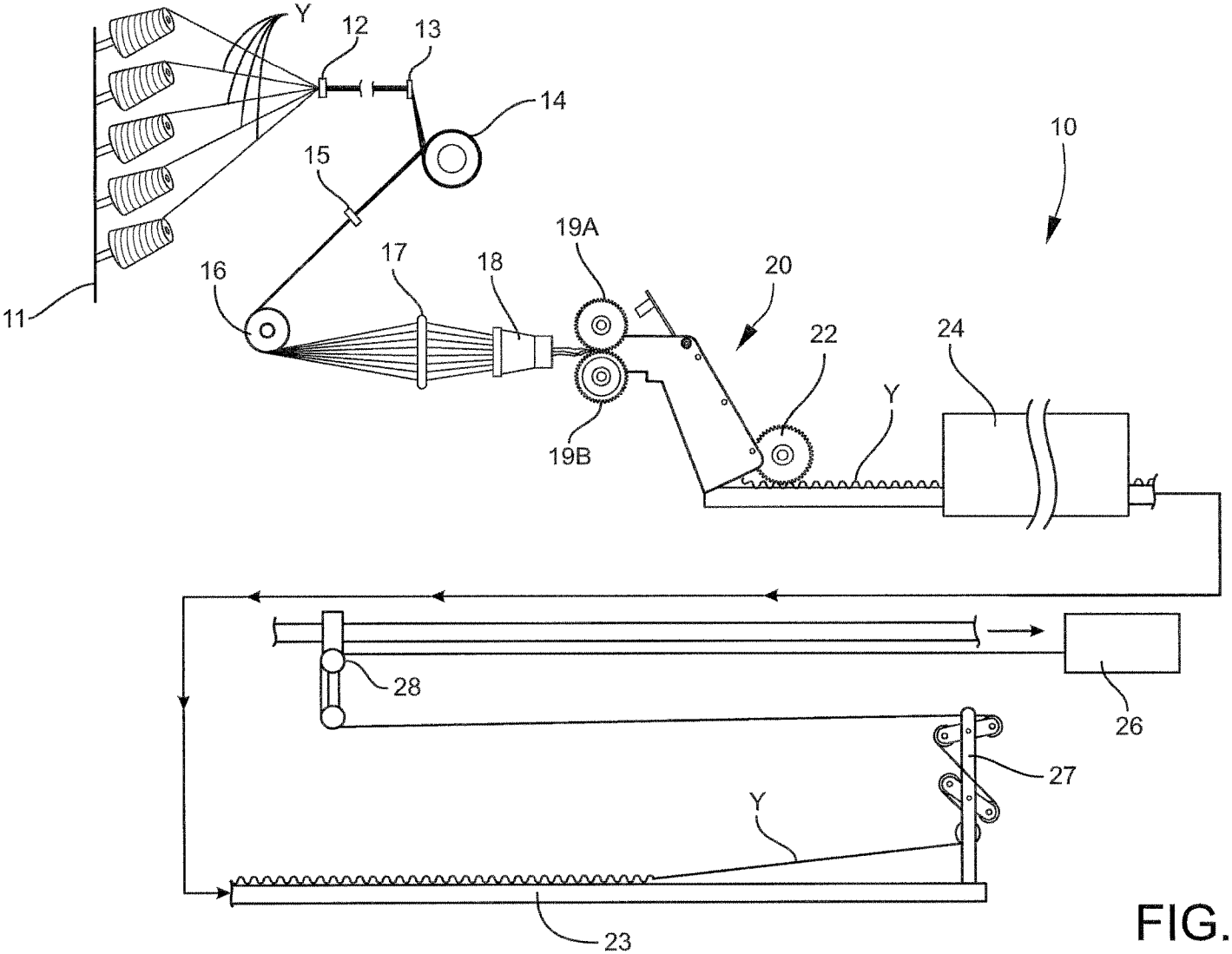
FIG. 1 is a schematic view of a textile processing assembly according to one exemplary embodiment of the present disclosure.

Referring now specifically to the drawings, a textile processing assembly according to one exemplary embodiment of the present invention is illustrated schematically in FIG. 1, and shown generally at reference numeral 10. In one implementation, the textile processing assembly 10 is applicable for texturing and heat-setting ply-twisted multifilament yarn, such as that used in saxony, plush, textured and frieze-type carpets. The term "ply-twisted multifilament yarn" refers to a multifilament yarn constructed by cabling together two or more single yarns by, for example, a two step twisting/cabling process or a direct cabling process, both of which are commonly known to those skilled in the art. The ply-twisted yarn may have a denier in the range of about 900 to 2800, and may be composed of either bulked continuous filament (BCF) yarns or staple spun yarns, for example. The assembly 10 may also be used to process other yarns including tow.

As illustrated in FIG. 1, multiple ends of yarn "Y" are supplied from a creel 11 and moved downstream in respective continuous lengths through guides 12 and 13, around an inverter-driven overfeed roll 14, through guide 15, and over guide roll 16. The overfeed roll 14 adjusts the yarn speed for tension variations. From the guide roll 16, the yarn ends "Y" passed through guide 17 to a false twister 18. The false twister 18 may comprise a bi-directionally rotating disk with multiple spaced opening for receiving respective yarn ends "Y". As commonly known and understood by those skilled in the art, the false twister 18 operates using conventional drive means (not shown) to twist and untwist the yarn strands. The yarn ends "Y" move downstream from the false twister 18 to cooperating inverter-driven feed rolls 19A and 19B. The feed rolls 19A, 19B drive the yarn ends "Y" into a textile stuffer box 20, described in detail below, where the moving yarn is axially compressed (or "crimped") to add texture. The stuffer box 20 can be operated with or without steam to influence the texture, and can generally process several ends simultaneously depending on yarn size. The yarn speed through the stuffer box 20 may be infinitely variable between, for example, 250 m/min and 700 m/min. The medium yarn speed for polypropylene is approximately 450 m/min, and approximately 550 m/min for polyester and nylon.

Upon exiting the stuffer box 20, the textured yarn "Y" flows to an inverter-driven compression roll 22, and onto an inverter-driven, variable speed conveyor belt 23. The conveyor belt 23 transfers the textured yarn "Y" into and through a climate chamber 24 to heat-set the twist. The climate chamber 24 may comprise a conventional heat-setting machine, such as that known commercially as a "Superba", which treats the yarn with pressurized saturated steam. Alternatively, the climate chamber 24 may comprise a machine known commercially as a "Suessen" which treats the yarn with dry heat to heat-set the twist. The speed of the conveyor belt 23 is controlled in order to transport the textured yarn "Y" through the climate chamber 24 at a rate which yields the desired dwell time.

After heat-setting, the moving yarn "Y" accumulates downstream on the conveyor 23 for cooling, and is pulled off the belt by a winder 26. Prior to winding, the yarn "Y" undergoes a process (referred to as "shake-out") designed to separate and untangle the individual ends. From the conveyor 23, the yarn passes through a tension tower 27, and is taken back towards the climate chamber 24 by an adjustable traveling distance extender 28. The yarn "Y" extends from the distance extender 28 back to the winder 26 where it is wound on individual cones (not shown). The winder 26 may comprise, for example, an automatic doffing winder, or other suitable yarn take-up device.

In one exemplary application, the resulting textured and heat-set yarn "Y" may be tufted into the backing of a carpet. The carpet may then be dyed and subjected to other standard finishing operations including stain and soil resist treatment followed by shearing of the tufts.

Textile Stuffer Box 20

Figure 2:
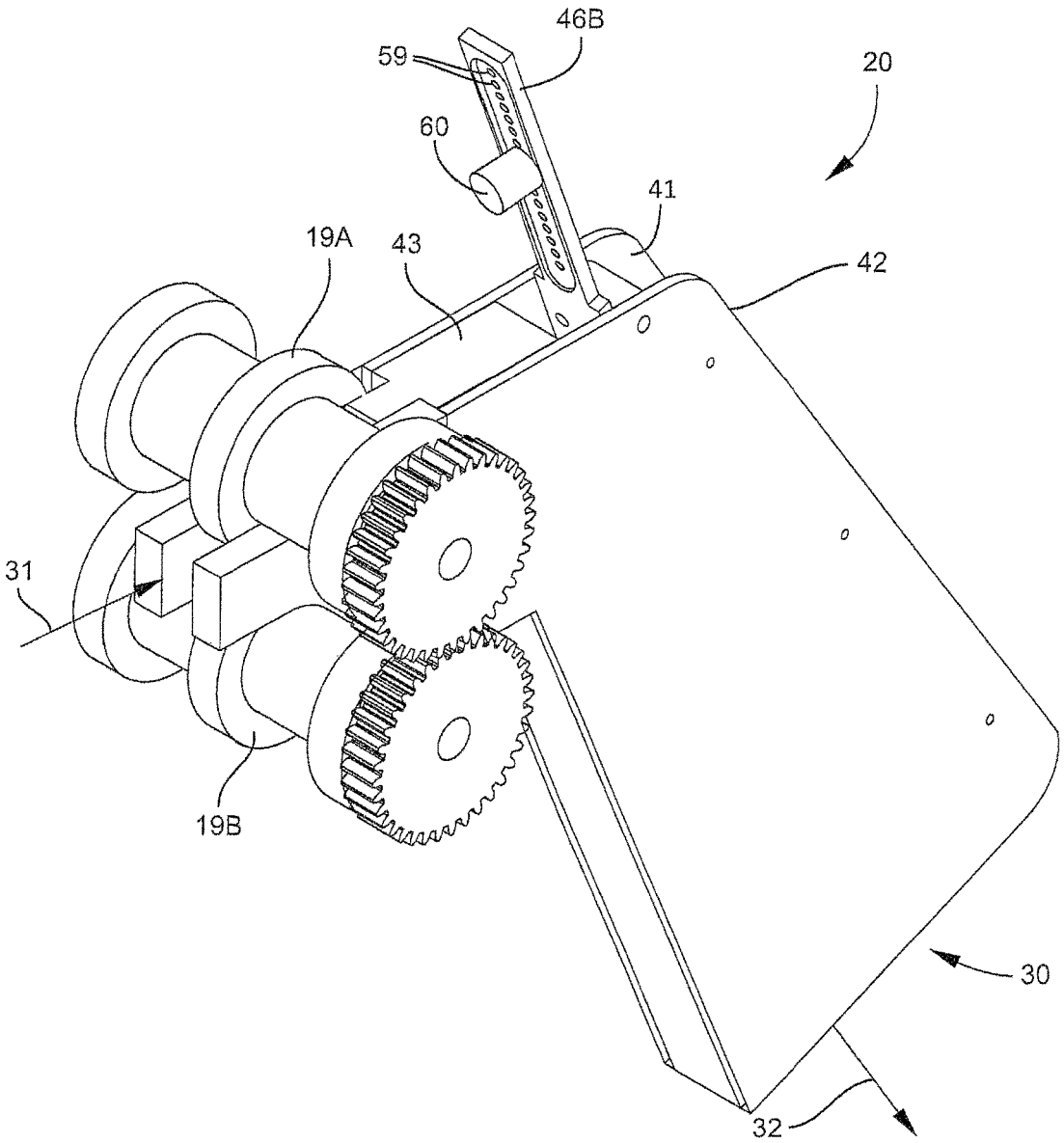
FIG. 2 is perspective view of an exemplary textile stuffer box used in the processing assembly of FIG. 1, and located immediately downstream of cooperating feed rolls.
Figure 3:
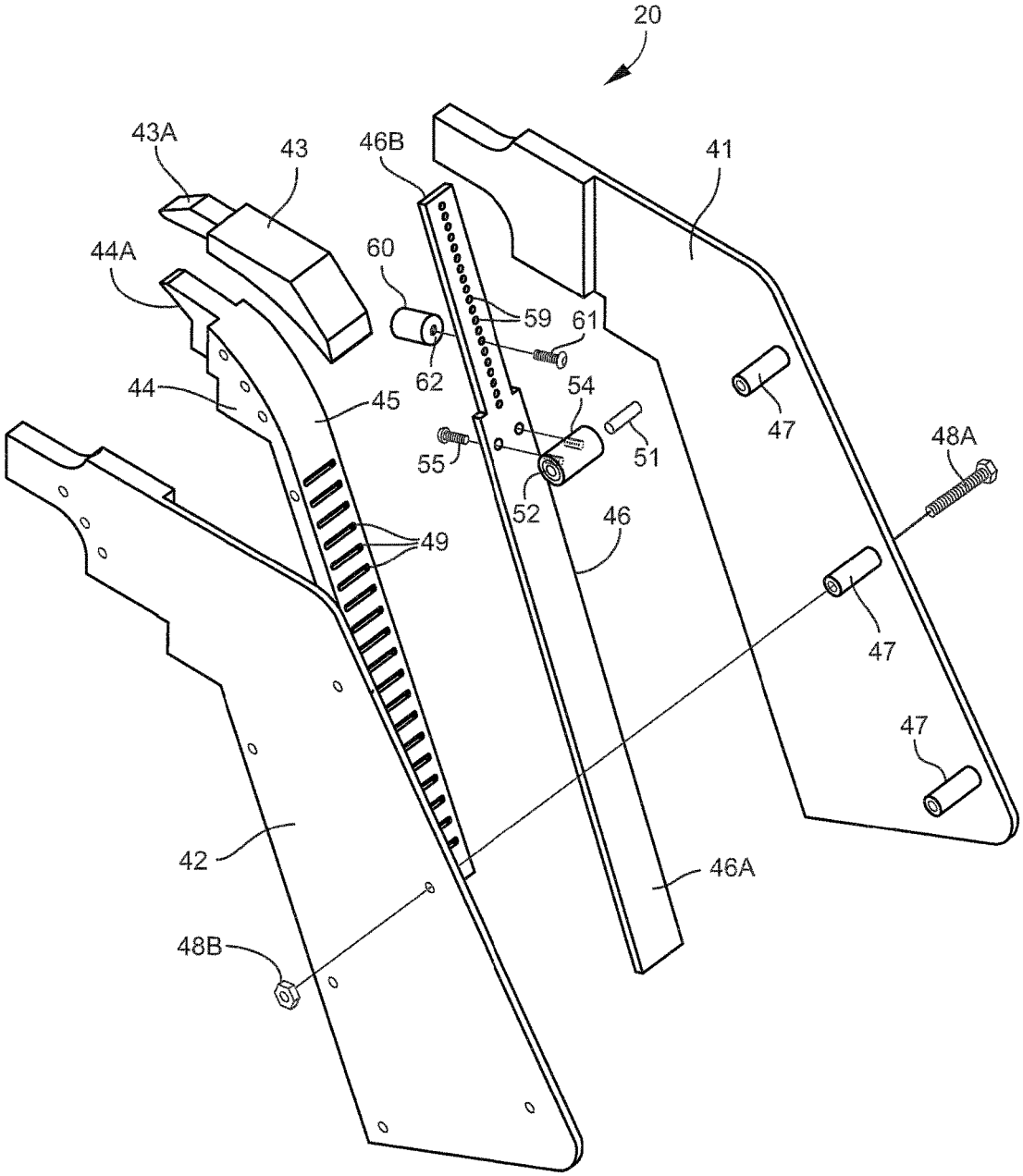
FIG. 3 is an exploded perspective view of the exemplary stuffer box.

Referring to FIGS. 1, 2, and 3, the textile stuffer box 20 is located immediately downstream of the feed rolls, as previously described, and operates to texture or "crimp" the ply-twisted yarn "Y" prior to heat-setting. In the present exemplary embodiment, the stuffer box 20 incorporates a housing assembly 30 having an entrance and exit through which the moving yarn passes, as represented by arrows 31 and 32 in FIG. 2, and internal chamber-forming surfaces cooperating to define a multi-stage crimping chamber 35 (FIG. 4) for receiving and accumulating the moving length of ply-twisted yarn. The exemplary housing assembly 30 comprises opposing side plates 41, 42, top and bottom chamber blocks 43, 44, an angled gravity-feed yarn slide 45, and a pivoted weight-balanced chamber gate 46. The side plates 41, 42 are separated by rigid spacers 47 and are joined together by hardware 48A, 48B, such as complementary-threaded bolts and nuts. At least one (or a portion of one) of the side plates 41, 42 comprises a window constructed of a substantially transparent material, such as Lexan® polycarbonate, to enable ready viewing of yarn accumulating inside the crimping chamber 35. The top and bottom chamber blocks 43, 44 define solid continuous top and bottom surfaces of the crimping chamber 35, and are affixed to the side plates 41, 42 by other hardware, adhesives, or the like. The exemplary chamber blocks 43, 44 may be constructed of aluminum or other metal, molded polymer, or other suitable material. The gravity-feed yarn slide 45 extends downwardly at a fixed angle between the side plates 41, 42, and may be integrally or separately formed adjacent the bottom chamber block 44. In one embodiment, the yarn slide 45 is constructed of aluminum or other metal, and is laterally-scored or textured at spaced apart locations 49 between its top and bottom ends, thereby interrupting or slowing continuous downstream flow of yarn through the stuffer box 20.

The weight-balanced chamber gate 46 is pivotably mounted to the housing assembly 30 at a fulcrum assembly 50, and comprises an inside-the-chamber first end 46A and an outside-the-chamber second end 46B—the first and second ends 46A, 46B extending respectively from the fulcrum assembly 50. The fulcrum assembly 50 includes a gate pin 51 fixed between side plates 41, 42 of the housing assembly 30, a metal bushing 52 freely carried on the pin 51, and an outside cylindrical (e.g., nylon) mount 54 formed with the bushing 52. The chamber gate 46 is attached to the cylindrical mount 54 by screws 55 or other suitable means, and is adapted to freely pivot within about a 30 to 45 degree range indicate at arrow 58 in FIG. 4. The first end 46A of the chamber gate 46 defines a substantially flat, continuous, and movable chamber-forming surface adjacent the yarn exit of the housing assembly 30. The outside-the-chamber second end 46B of the chamber gate 46 defines uniformly spaced gate holes 59 forming respective mounting points for carrying a removable stainless steel gate weight 60 at a selected location along chamber gate 46. A threaded mounting pin 61 inserts through a selected one of the gate holes 59 into a complementary threaded opening 62 formed with the weight 60 to temporarily secure the weight to the chamber gate 46. Selectively positioning and repositioning the gate weight 60 allows an operator to adjustably increase and decrease a precise resistance exerted by the chamber gate 46 on yarn exiting the stuffer box 20, thereby controlling axial compression of yarn accumulating inside the crimping chamber 35.

Figure 4:
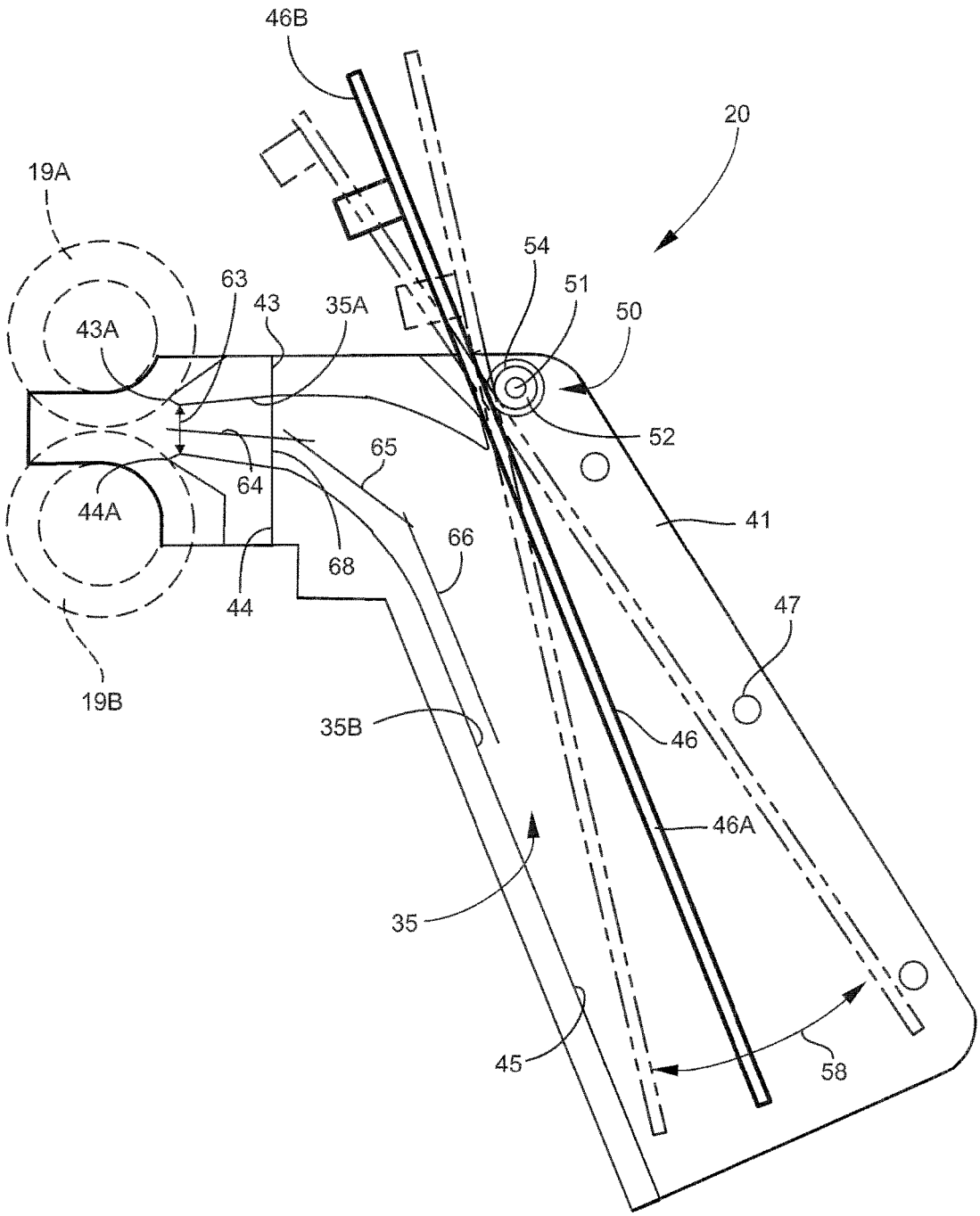
FIG. 4 is a side view of the exemplary stuffer box with a side plate removed and certain parts indicated in broken lines.
Figure 5:
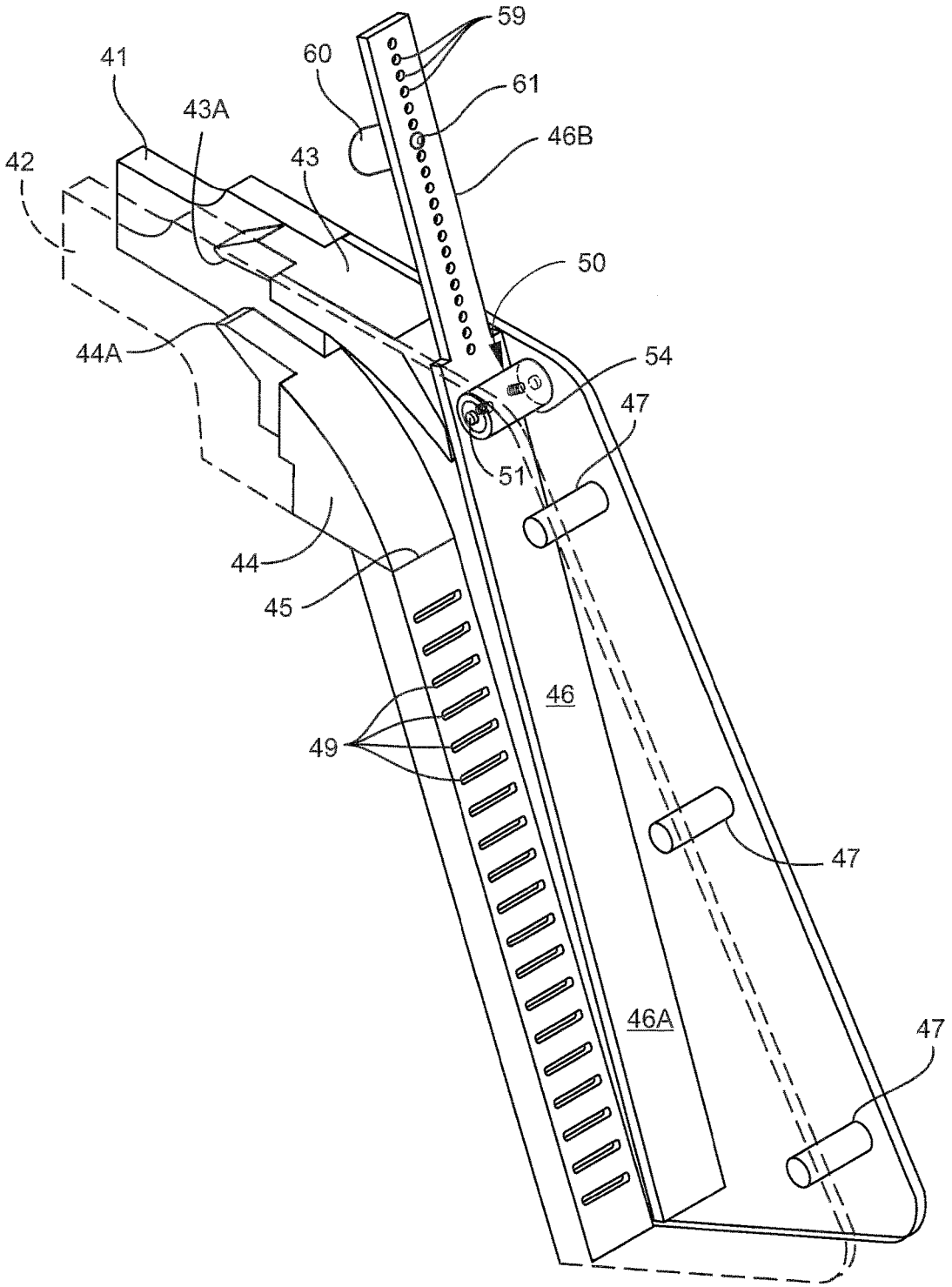
FIG. 5 is a perspective view of the exemplary stuffer box with a side plate hidden and represented in broken lines.

As best shown in FIGS. 4 and 5, the opposing side plates 41, 42 and top and bottom chamber blocks 43, 44 of the housing assembly 30 form a first (or "upstream") fixed-volume stage 35A of the crimping chamber 35. The chamber blocks 43, 44 have respective substantially horizontal yarn-guiding blades 43A, 44A located at the entrance of the housing assembly 30 adjacent the feed rolls 19A, 19B. The yarn-guiding blades 43A, 44A are substantially vertically and horizontally aligned, and cooperate at respective upstream edges to reduce the occurrence of hanging filaments between the feed rolls 19A, 19B. The yarn-guiding blades 43A, 44A comprise substantially identical (mirrored) top and bottom walls of the fixed-volume stage 35A of crimping chamber 35, and form a slight inwardly-spaced constriction 63 (FIG. 4) at a mouth of the crimping chamber 35 before opening to a more expansive downwardly curved passage. As indicated in FIG. 5, the fixed-volume stage 35A has a height dimension "H" defined generally by the vertical spacing between yarn-guiding blades 43A, 44A, a length dimension "L" defined generally by coextensive (horizontal) lengths of the yarn-guiding blades 43A, 44A, and a relatively narrow width dimension "W" between side plates 41, 42 and defined by the coextensive widths of the yarn guiding blades 43A, 44A. Direction lines 64, 65, 66 of FIG. 4 represent generally the angles of yarn flow through the fixed-volume upstream stage 35A and adjustable-volume downstream stage 35B of the crimping chamber 35 downstream towards the housing exit. In the fixed-volume upstream stage 35A, yarn entering the stuffer box 20 travels in a substantially horizontal path as indicated generally at line 64, and then along an arcuate transition indicated generally at tangent line 65—line 65 being approximately 140 degrees to line 64.

The "downstream" adjustable-volume stage 35B of the crimping chamber 35 is formed by opposing side plates 41, 42, the gravity-feed yarn slide 45, and the pivoted chamber gate 46. This stage 35B of the crimping chamber 35 has an adjustable size or volume dependant upon a selected location of the removable gate weight 60 and the resulting resistance exerted by the chamber gate 46 on yarn exiting the stuffer box 20. Line 66 in FIG. 4 is approximately 120 degrees to line 64, and represents the general path of descending yarn flow through this second stage 35B of the crimping chamber 35. Broken line 68 in FIG. 4 generally divides the fixed-volume and adjustable-volume stages 35A, 35B of the crimping chamber 35.

Figure 6:
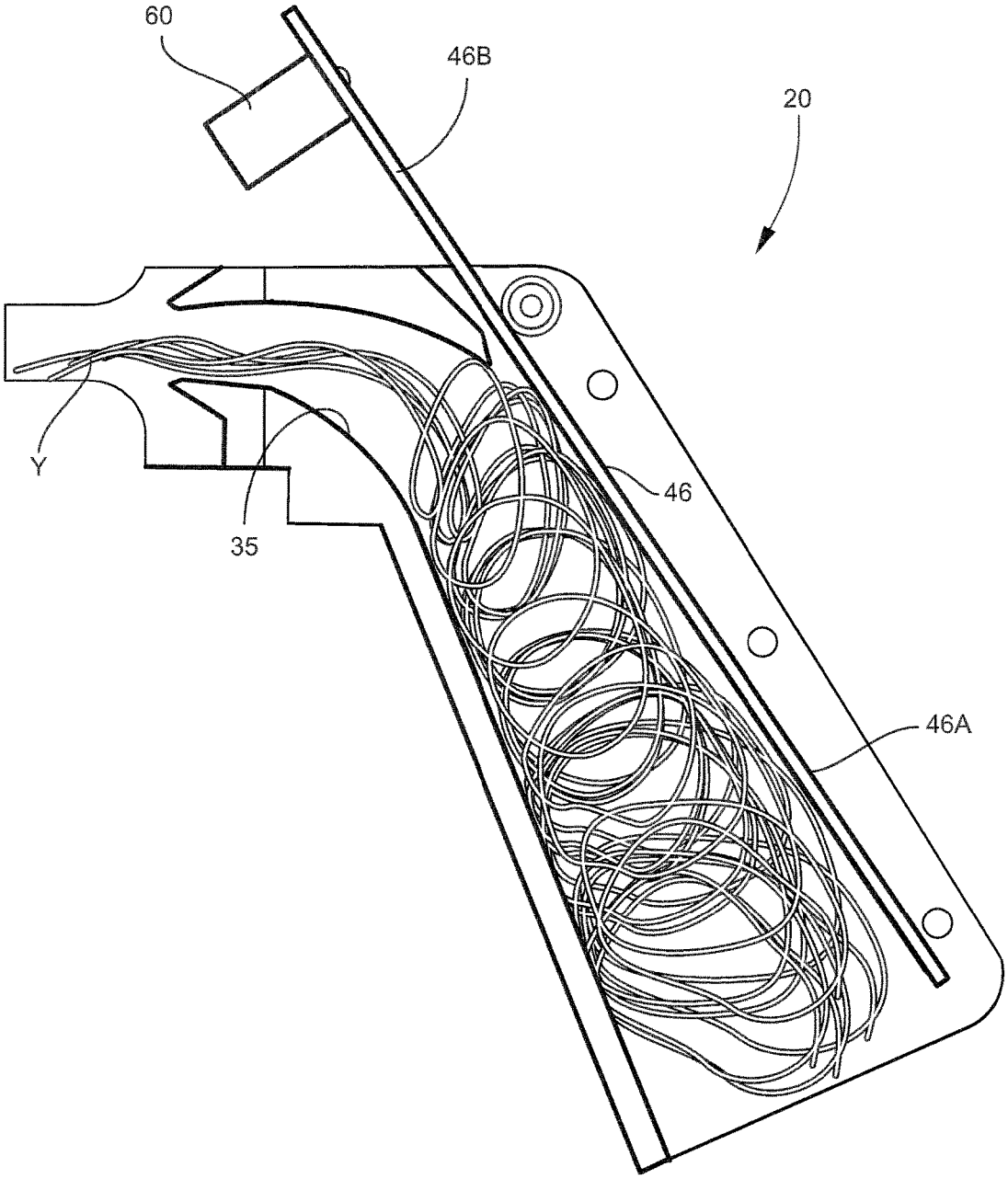
FIGS. 6, 7, and 8 are further side views (with a side plate removed) demonstrating performance of the exemplary stuffer box for texturing or crimping yarn at different resistance settings of the weight-balanced gate.
Figure 7:
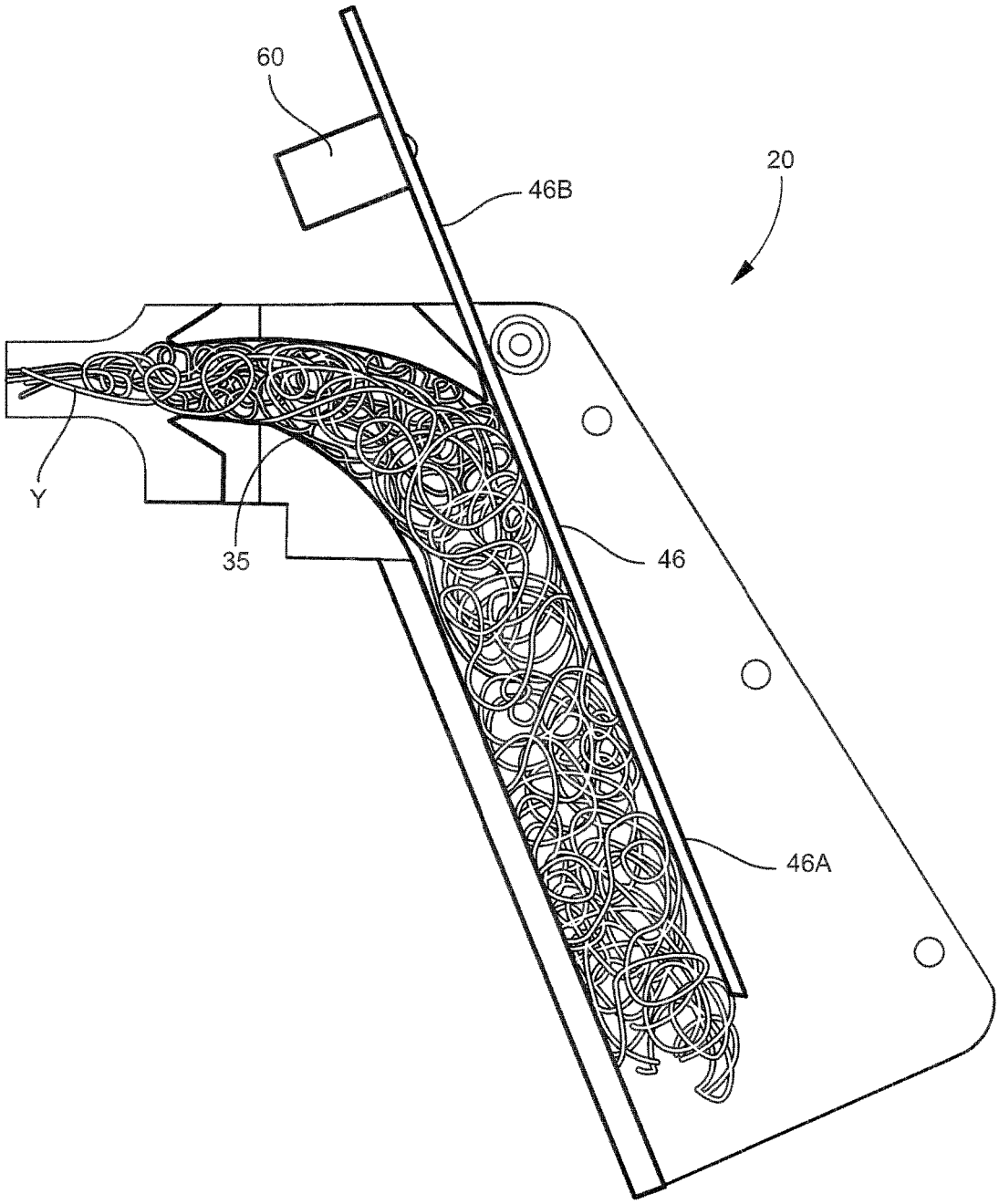
Figure 8:
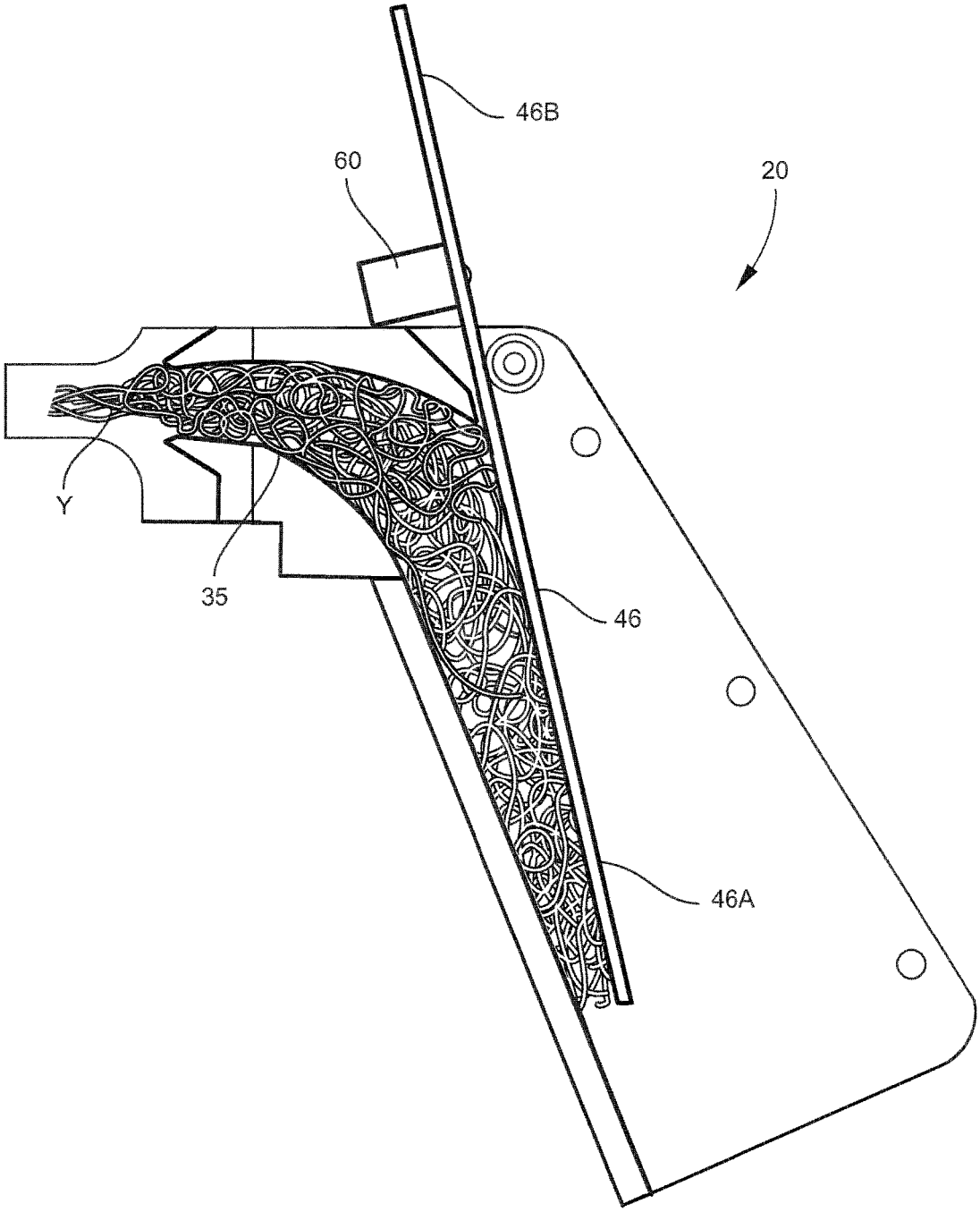

FIGS. 6, 7, and 8 illustrate performance of the chamber gate 46 in the exemplary stuffer box 20. When the removable weight 60 is located at a top gate end 46B, as shown in FIG. 6, the weight 60 substantially counterbalances the opposite gate end 46A, and exerts the least amount of resistance to downstream movement of yarn "Y" through the stuffer box 20. As a result, less yarn tends to accumulate and compress inside the crimping chamber 35—creating low (or almost no) yarn texturing. In this setting, the yarn "Y" essentially by-passes the fixed-volume stage 35A of the crimping chamber 35. When the weight 60 is positioned at mid-point of gate end 46B, as shown in FIG. 7, the chamber gate 46 exerts added resistance to downstream movement of the yarn "Y". In this position, the weight-balanced gate 46 tends to reduce an overall size or volume of the crimping chamber 35 in the adjustable-volume stage 35B thereby increasing the accumulation or "backing up" of yarn in the fixed-volume stage 35A (where texturing occurs). This results in tighter turns, sharper bends and folds in the fixed-volume stage 35A before opening to the larger adjustable-volume stage 35B where the yarn generally relaxes before exiting the steer box 20. The greatest gate resistance is achieved by locating the weight 60 in its lowermost position on gate end 46B, as shown in FIG. 8. This added resistance further narrows the opening at the housing exit, and results in further increased accumulation of yarn inside the fixed-volume chamber 35A and added texture. The exact yarn texture or crimping can be selectively adjusted by the operator by positioning the removable weight 60 at any one of the mounting points 59 (FIG. 5) formed along the gate end 46B.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention.

What is claimed:

1. A textile processing assembly for texturing and heat-setting a moving length of ply-twisted yarn, said textile processing assembly comprising:

(a) a pair of feed rolls adapted for engaging and moving the yarn downstream away from a supply creel;

(b) a textile stuffer box downstream of said feed rolls, and comprising:

(i) a housing assembly having a yarn entrance and a yarn exit, and comprising cooperating chamber-forming surfaces defining a multi-stage internal crimping chamber for receiving and accumulating the ply-twisted yarn between the entrance and exit of said housing assembly, said crimping chamber comprising an upstream fixed-volume stage and a downstream adjustable-volume stage;

(ii) means for selectively adjusting a volume of the downstream adjustable-volume stage of said crimping chamber, thereby controlling axial compression of yarn accumulating inside the upstream fixed-volume stage of said crimping chamber, wherein said means for selectively adjusting a volume of the downstream adjustable-volume stage of said crimping chamber comprises an elongated chamber gate extending linearly between opposing terminal end edges and a removable gate weight, said chamber gate being pivotably mounted to said housing assembly at an intermediate fulcrum point of said chamber gate, and said fulcrum point dividing said chamber gate to form an inside-the-chamber first end defining at least one of said chamber-forming surfaces adjacent the yarn exit of said housing assembly, and an outside-the-chamber second end comprising a removable gate weight, and said first and second ends of said chamber gate being integrally formed together as a single elongated structure, and said gate weight being selectively positioned along the outside-the-chamber second end of said chamber gate to adjustably increase and decrease a resistance exerted by said chamber gate, whereby selective adjustment of the gate resistance operates to control axial compression of yarn accumulating inside of said crimping chamber;

(c) a climate chamber downstream of said stuffer box, and adapted for heat-setting the ply-twisted yarn;

(d) means for conveying the yarn downstream from said stuffer box and through said climate chamber; and (e) a take-up winder downstream of said climate chamber for collecting the processed yarn.

2. The textile processing assembly according to claim 1, wherein the outside-the-chamber second end of said chamber gate comprises a plurality of longitudinally spaced mounting points for selectively locating said gate weight.

3. The textile processing assembly according to claim 2, wherein said mounting points comprise respective uniformly spaced gate holes formed with said chamber gate, and adapted for receiving a weight mounting pin to temporarily secure the weight to the chamber gate.

4. The textile processing assembly according to claim 1, wherein said housing assembly comprises opposing spaced apart side plates.

5. The textile processing assembly according to claim 4, and comprising a gate pin extending between the side plates of said housing assembly, and pivotably carrying said chamber gate at a point between said inside-the-chamber first end and said outside-the-chamber second end.

6. The textile processing assembly according to claim 5, wherein said textile stuffer box comprises a plurality of rigid chamber spacers extending between the side plates of said housing assembly.

7. The textile processing assembly according to claim 1, wherein said textile stuffer box comprises a gravity-feed yarn slide extending downwardly at an angle between the entrance and exit of said housing assembly.

8. The textile processing assembly according to claim 7, wherein said gravity-feed yarn slide extends at a downward angle of between about 45 and 75 degrees from the entrance to the exit of said housing assembly.

9. The textile processing assembly according to claim 8, wherein said gravity-feed yarn slide is laterally-scored at spaced apart locations between a top of the slide and a bottom of the slide.

10. The textile processing assembly according to claim 1, wherein said textile stuffer box comprises top and bottom yarn-guiding blades located at the entrance of said housing assembly adjacent said feed rolls.

11. A textile stuffer box for texturing yarn, comprising:

a housing assembly having a yarn entrance and a yarn exit, and comprising cooperating chamber-forming surfaces defining a multi-stage internal crimping chamber for receiving and accumulating ply-twisted yarn between the entrance and exit of said housing assembly, said crimping chamber comprising an upstream fixed-volume stage and a downstream adjustable-volume stage; and means for selectively adjusting a volume of the downstream adjustable-volume stage of said crimping chamber, thereby controlling axial compression of yarn accumulating inside the upstream fixed-volume stage of said crimping chamber, wherein said means for selectively adjusting a volume of the downstream adjustable-volume stage of said crimping chamber comprises an elongated chamber gate extending linearly between opposing terminal end edges and a removable gate weight, said chamber gate being pivotably mounted to said housing assembly at an intermediate fulcrum point of said chamber gate, and said fulcrum point dividing said chamber gate to form an inside-the-chamber first end defining at least one of said chamber-forming surfaces adjacent the yarn exit of said housing assembly, and an outside-the-chamber second end comprising a removable gate weight, and said first and second ends of said chamber gate being integrally formed together as a single elongated structure, and said gate weight being selectively positioned along the outside-the-chamber second end of said chamber gate to adjustably increase and decrease a resistance exerted by said chamber gate, whereby selective adjustment of the gate resistance operates to control axial compression of yarn accumulating inside of said crimping chamber.

12. The textile stuffer box according to claim 11, wherein the outside-the-chamber second end of said chamber gate comprises a plurality of longitudinally spaced mounting points for selectively locating said gate weight.

13. The textile stuffer box according to claim 12, wherein said mounting points comprise respective uniformly spaced gate holes formed with said chamber gate, and adapted for receiving a weight mounting pin to temporarily secure the weight to the chamber gate.

14. The textile stuffer box according to claim 13, and comprising a gate pin extending between opposing side walls of said housing assembly, and pivotably carrying said chamber gate at a point between its said inside-the-chamber first end and its said outside-the-chamber second end.

15. The textile stuffer box according to claim 14, wherein said textile stuffer box comprises a plurality of rigid chamber spacers extending between opposing side walls of said housing assembly.

16. The textile stuffer box according to claim 11, and comprising a gravity-feed yarn slide extending downwardly at an angle between the entrance and exit of said housing assembly.

17. The textile stuffer box according to claim 16, wherein said gravity-feed yarn slide is laterally-scored at spaced apart locations between a top of the slide and a bottom of the slide.

* * * * *